United States Patent [19]

Easton et al.

[11] Patent Number: 4,818,251

[45] Date of Patent: Apr. 4, 1989

[54] REMOVAL OF WATER HAZE FROM DISTILLATE FUEL

[75] Inventors: Thomas Easton; Bryan Thomas, both of Barry, Wales

[73] Assignee: Dow Corning Ltd., Barry, Wales

[21] Appl. No.: 187,112

[22] Filed: Apr. 28, 1988

[30] Foreign Application Priority Data

May 8, 1987 [GB] United Kingdom ..... 8710889

[51] Int. Cl.[4] ..... C10L 1/28

[52] U.S. Cl. ..... 44/72; 44/75; 44/76; 208/188

[58] Field of Search ..... 44/72, 75, 76; 208/188

[56] References Cited

U.S. PATENT DOCUMENTS

| | | | |
|---|---|---|---|
| 2,476,308 | 7/1949 | Klein | 252/312 |
| 3,249,535 | 5/1966 | Kell | 252/8.3 |
| 3,963,726 | 6/1976 | Pepe et al. | 260/290 |
| 4,002,558 | 1/1977 | Feldman | 208/188 |
| 4,059,581 | 11/1977 | Prokai | 544/69 |
| 4,183,820 | 1/1980 | Theile et al. | 252/342 |
| 4,381,241 | 4/1983 | Romenesko et al. | 252/8.5 |
| 4,417,066 | 11/1983 | Westall | 556/425 |
| 4,460,380 | 7/1984 | Rehrer | 44/76 |
| 4,596,653 | 6/1986 | Graham et al. | 208/188 |
| 4,631,273 | 12/1986 | Blehm et al. | 514/29 |
| 4,639,321 | 1/1987 | Barrat et al. | 252/8.8 |

FOREIGN PATENT DOCUMENTS

| | | | |
|---|---|---|---|
| 1360398 | 7/1974 | United Kingdom | 208/188 |
| 2173510A | 10/1986 | United Kingdom . | |

*Primary Examiner*—William R. Dixon, Jr.
*Assistant Examiner*—Jerry D. Johnson
*Attorney, Agent, or Firm*—Alexander Weitz

[57] ABSTRACT

The specification discloses a method of de-hazing distillate fuel which comprises adding to the fuel an organosiloxane having at least one quaternary ammonium substituted siloxane unit having the general formula $$R_aZSiO_{(3-a)/2} \quad (i)$$

in which a has the value of 1 or 2, each R represents a substituted or unsubstituted hydrocarbon group of up to 10 carbon atoms provided that one of the Rs may be a hydroxyl group when a has the value 2, Z represents a quaternary ammonium group $$R'N^+(R^2)_3X^- \quad (ii)$$

linked to the silicon atom of the siloxane unit, R′ represents a divalent hydrocarbon group linking the silicon and nitrogen atoms, each $R^2$ represents an alkyl group having up to 20 carbon atoms and $X^-$ represents a halogen ion. Preferred organosiloxanes also comprise siloxane units according to the general formula $$R_bSiO_{(4-b)/2} \quad (iii)$$

in which each R is a substituted or unsubstituted hydrocarbon group of up to 10 carbon atoms and b has the value 1, 2, or 3 and may be according to the average general formula $$R_3SiO(R_2SiO)_x(RSiOR'N^+(R^2)_3X^-)_ySiR_3 \quad (iv)$$

in which x has a value in the range 1 to 150, y has a value in the range 1 to 10 and the ratio of x+y/y lies in the range 2 to 25. In preferred organosiloxanes two of the groups $R^2$ have 1 to 5 carbon atoms and one of the groups $R^2$ has a chain of 10 to 15 carbon atoms.

19 Claims, No Drawings

REMOVAL OF WATER HAZE FROM DISTILLATE FUEL

This invention is concerned with removal of water haze from distillate fuel.

By the expression "distillate fuel" where used herein, we mean distilled hydrocarbon fuels which boil in the range of about 70° C. to about 500° C. The distillate fuel may comprise atmospheric distillate or cracked gas oil or a blend of straight run or cracked distillates. The common distillate fuels are motor spirit, kerosene, jet fuel and diesel fuel.

Distillate fuels usually contain a minor amount of water i.e. about 100 to 300 parts of water per million parts of the fuel. Water is present in an aqueous phase in most fuel storage tanks and it is very difficult to ensure the fuel does not contain water. The water manifests itself as a haze in the liquid fuel. Presence of the haze in the fuel is regarded as technically unsatisfactory, for example, in view of the possibility of the water to coalesce slowly during storage and so provide a source of corrosion of storage vessels and pipes and in view of the possibility of the water to form ice at lower temperatures of use and thus interfere with supply of the fuel through supply pipes. The haze is also regarded as unsatisfactory from the aesthetic point of view.

It has been proposed to accelerate clearance of the haze by use of additives. For example, U.S. Pat. No. No. 4,002,558 discloses a method for removing water haze from a middle distillate fuel which comprises contacting the fuel with a specified amount of a solution of an inorganic halide or nitrate of calcium, magnesium, cadmium, copper or nickel in a fuel immiscible aliphatic monohydric alcohol, polyhydric alcohol or glycol ether. The preferred additive composition referred to in the specification is a solution of MgCl2.6H2O dissolved in methanol.

U.S. Pat. No. 4,460,380 discloses the use of certain block copolymers of organosiloxane and polyoxyalkylene oxide for separating out or otherwise reducing water haze in middle distillate petroleum fuel. Block copolymers employed in the examples of the patent include a primary hydroxyl functional polydimethylsiloxanepolyoxyethylene copolymer commercially available as Dow Corning® Q4-3667. Block copolymers as referred to in this specification are effective dehazing materials for certain fuels.

We have now found that certain quaternary ammonium substituted polydiorganosiloxanes have excellent de-hazing properties. In particular, we have now found that certain organosiloxanes having at least one siloxane unit which has a trialkyl quaternary ammonium group attached to its silicon atom are operative de-hazing materials for certain distillate fuels.

The present invention provides in one of its aspects a method of de-hazing distillate fuel which comprises adding to the fuel an organosiloxane having at least one quaternary ammonium substituted siloxane unit having the general formula $$R_aZSiO_{(3-a)/2} \quad \text{(i)}$$

in which a has the value 1 or 2, each R represents a substituted or unsubstituted hydrocarbon group of up to 10 carbon atoms provided that one of the Rs may be a hydroxyl group when a has the value 2, Z represents a quaternary ammonium group $$R'N^+(R^2)_3X^- \quad \text{(ii)}$$

linked to the silicon atom of the siloxane unit, R′ represents a divalent hydrocarbon group linking the silicon and nitrogen atoms, each $R^2$ represents an alkyl group having up to 20 carbon atoms and $X^-$ represents a halogen ion.

A method according to the present invention is applicable to distillate fuels in general and in particular is beneficial in respect of diesel fuel. By the expression "diesel fuel" where used herein is meant gas oil and fuel oil including those materials which are referred to as light domestic and heating oils and diesel fuel and irrespective of whether they are intended for vehicular, marine, heating or other use. These materials are loosely characterised as having a viscosity of not more than 115″ Redwood 1 at 38° C. and a boiling point in the range of about 200° C. to about 380° C. Particularly embraced within the expression are those hydrocarbon liquids having a viscosity of about 30 to about 40″ Redwood 1 at 38° C. including those having a viscosity at 20° C. in the range of about 2.9 to about 10.2 centistokes and at 38° C. in the range of about 1.6 to about 6.0 cS.

In a method according to the invention the distillate fuel is preferably a diesel fuel used as a fuel for motor vehicles, e.g. cars and heavy goods vehicles, as a heating fuel or as a marine engine fuel. However, a method according to the invention may also find use, at least to a limited extent, for de-hazing of other distillate fuels, for example, motor spirit i.e. light oil distilling between 70° C. and 200° C. and treated to reach an octane number (RON) >85, aviation spirit, fuels for jet engines, residual fuel oils having a viscosity at 38° C. of greater than 115″ Redwood 1, light medium and heavy naphthas and vapourising oils.

Distillate fuel frequently contains additives intended to enhance various properties of the fuel but which under some conditions may serve to stabilize haze in the fuel. Additives may be present for example as wax crystal modifiers, pour point depressants, cold flow improvers, or viscosity modifiers. Materials often present as additives in diesel fuel include, for example, copolymers of ethylene with unsaturated esters e.g. vinyl acetate, vinyl butyrate, various acrylates and fumarates, polymeric esters of higher olefins and unsaturated alkyl esters, amine salts and amides.

The selection of the most effective quaternary ammonium organosiloxane de-hazer for a particular distillate fuel varies from distillate fuel to distillate fuel and appears to depend on characteristics of the oily and aqueous phases. The effectiveness of the de-hazing agents under field operating conditions is not readily predictable, but may be ascertained by a simple testing procedure. Thus, samples of the organosiloxanes may be mixed with the hazy distillate fuel, the mixture shaken and blended. At intervals, the light transmittance properties of samples of the fuel may be determined and thus a measure of the effectiveness of the organosiloxane as a de-hazer may be found. Whilst not wishing to be bound by any particular theory, we believe the effectiveness of these materials as de-hazers derives from a number of factors including, for example, the ability of the organosiloxane to permit at least some of its substituents to be present in the oily phase of the fuel whilst its quaternary ammonium groups are able to disturb the emulsifier system supporting the haze sufficiently for the haze to clear more quickly.

The organosiloxanes used in a method according to the invention may be linear or branched and may have any desired number of siloxane units. Preferably the organosiloxane has 2 to 2000 silicon atoms. The organosiloxane may be composed exclusively of units (i). However, we prefer that the organosiloxane is a polydiorganosiloxane composed of siloxane units (i) and siloxane units according to the general formula $$R_bSiO_{(4-b)/2} \quad \text{(iii)}$$

in which each R is a substituted or unsubstituted hydrocarbon group of up to 10 carbon atoms and b has the value 1, 2, or 3. The units (iii) may thus be present as chain units, chain branching units or terminal units of the organosiloxane molecule and the units (i) may be present as chain units or as terminal units. The group R of units (i) and (iii) is preferably an unsubstituted alkyl, aryl, alkaryl, aralkyl or cycloaliphatic group. The most preferred groups are the lower alkyl groups, for example methyl, ethyl and propyl and the phenyl group. Preferably not less than 80% of the groups R are methyl.

In units of formula (i), the group R' linking the silicon and nitrogen atoms is a divalent hydrocarbon group, for example an alkylene group according to the formula $-(CH_2)_n-$ where n has a value in the range 2 to 10.

In units of formula (i), the alkyl groups $R^2$ may be the same or different. Preferably, two of the groups $R^2$ have 1 to 5 carbon atoms, for example the methyl or ethyl groups, and one of the groups $R^2$ has a chain of 10 to 15 carbon atoms.

In units of formula (i),the halogen ion $X^-$ may be any of those commonly available, for example, iodide or chloride.

The organosiloxanes which are most effective dehazers for particular distillate fuels may be determined by inspection of light transmittance as aforesaid. The effectiveness of the organosiloxanes in a particular fuel appears to be related to the structure of the organosiloxane and some of the organosiloxanes are more effective in de-hazing fuels containing additives than are others. Organosiloxanes which are effective de-hazers include the linear polydiorganosiloxanes according to the average general formula $$R_3SiO(R_2SiO)_x(RSiOR'N^+(R^2)_3\,X^-)_ySiR_3$$

in which x has a value in the range 1 to 150 and y has a value in the range 1 to 10. The ratio $(x+y)/y$ conveniently lies in the range 2 to 25. Preferably, the sum of $x+y$ lies in the range 2 to 20. Preferably, y has a value less than 5. Organosiloxanes which are effective de-hazers also include hydrolysates of dialkoxy silanes which consist principally of a mixture of linear and cyclic polysiloxanes having siloxane units according to the general formula $$(MeSiO_{\frac{1}{2}}R'N^+(R^2)_3X^-)_y$$

in which one group $R^2$ is an alkyl group having 12 to 14 carbon atoms, y has a value of about 5 to about 10, $X^-$ is chloride or iodide and Me represents a methyl group.

Quaternary ammonium salts of organosiloxanes are known materials. Organosiloxanes suitable for use in the present invention may be made by methods known in the art. They may be prepared, for example, from the corresponding tertiary amine and halogenated polysiloxane. A halohydrocarbyl polydiorganosiloxane may be prepared by hydrosilylation reaction between a hydrosiloxane and a halogenated unsaturated organic material or by copolymerisation of the corresponding dialkoxy haloalkylsilane with a polydiorganosiloxane. Quaternary ammonium salts also may be made by hydrolysis of the corresponding dialkoxy dialkyl quaternary ammonium silane, or by hydrolysis of the alkyl dialkoxy haloalkylsilane and subsequent treatment with the required trialkyl amine. We prefer to prepare the appropriate iodoalkyl substituted polydiorganosiloxane and then bring about reaction of this with the appropriate trialkyl amine.

In a method according to the invention, the organosiloxane may be incorporated into the distillate fuel in any convenient way e.g. via a metering device and may be introduced in diluted or undiluted condition. The materials are effective to accelerate de-hazing of the fuel when stirred or otherwise mixed into the fuel. They may also be effective de-hazers when applied on the surface of the fuel and allowed to spread on the surface of the fuel and diffuse into the body of the fuel. The amount introduced may be determined on a trial basis, but normally is not more than about 500 parts de-hazer per million parts fuel by volume. The organopolysiloxane may be introduced as sole de-hazer or may be introduced in conjunction with other materials, for example organic de-hazers of known type.

By use of a method according to the invention we have been able to de-haze some distillate fuels to a comparable or greater extent than was previously achieved. Particular benefits of the invention are shown with the more stable distillate fuel hazes.

In order that the invention may become more clear, there now follows a description of examples selected to illustrate the invention. In the examples all parts are by volume unless otherwise stated. The symbol Me represents the methyl group.

In examples 1 to 5, the performances as de-hazers for distillate fuels of various quaternary ammonium salts of organosiloxanes is compared with the performance of other materials. The comparisons were made using samples taken from a test batch. Test batches were prepared by mixing portions of distillate fuels with 0.1% distilled water using a high shear mixer. Stirring of the mixture in the high shear mixer was continued for 5 minutes in order to produce a batch of diesel fuel containing a stable haze. To portions of this mixture the desired amount of the subject de-hazer was introduced to provide the test batches. Periodically, sample portions were removed from the test batches, charged into clear glass containers and their light transmittance measured using a WPA C065 colorimeter. The proportion of incident light transmitted through each sample was recorded as a percentage. As the haze cleared the proportion of light transmitted increased. No haze was visible to the naked eye when the light transmittance had increased to about 97%. Preparation of the batches and testing of the samples were all undertaken at room temperature, i.e. 22° C.

Each of the illustrative organosiloxanes had at least one quaternary ammonium substituted siloxane unit according to the general formula $$R_aZSiO_{(3-a)/2} \quad \text{(i)}$$

in which a has the value 1 or 2, R represents Me, Z represents a quaternary ammonium group $R'N^+(R^2)_3X^-$ linked to the silicon atom of the siloxane unit, R' represents the group —$(CH_2)_3$— linking the silicon and nitrogen atoms, each $R^2$ represents an alkyl group having up to 20 carbon atoms and $X^-$ represents a halogen ion. Illustrative organosiloxanes 1, 2 and 3 were polyorganosiloxanes according to the general formula $$Me_3SiO(Me_2SiO)_x(MeSiOR'N_2^+(R_2)_3X^-)_ySiMe_3 \quad \text{(vi)}$$

in which R' is —$(CH_2)_3$—, two groups $R^2$ are methyl and one is an alkyl group having 12 to 14 carbon atoms. These illustrative organosiloxanes had the following characteristics:

| Illustrative Organosiloxane | x | y | (x + y)/y | $X^-$ |
|---|---|---|---|---|
| First | 71 | 4 | 18.75 | chloride |
| Second | 47.5 | 2.5 | 20 | chloride |
| Third | 6 | 2 | 4 | iodide |

Fourth and fifth illustrative organosiloxanes were hydrolysates of dimethoxy silanes and consisted principally of a mixture of linear and cyclic polysiloxanes having siloxane units according to the general formula $$(MeZSiO)_y, \quad \text{(vii)}$$

terminal units of the linear polysiloxanes having the general formula $$Me(OH)SiO_{\frac{1}{2}}Z \quad \text{(viii)}$$

in which units (vii) and (viii) Z is as defined above, R' is —$(CH_2)_3$—, two groups $R^2$ are methyl and one is an alkyl group having 12 to 14 carbon atoms and y had a value of about 7. In the fourth illustrative organosiloxane $X^-$ was chloride and in the fifth illustrative organosiloxane $X^-$ was iodide.

Comparative material A was $MgCl_2 \cdot 6H_2O$

Comparative material B was a polydiorganosiloxane polyoxyethylene glycol block copolymer comprising a centre block of about 15 dimethylsiloxane units and two hydroxyl terminated polyoxyethylene oxypropyl dimethyl silyl end blocks.

Comparative material C was a trimethylsilyl end-blocked polydiorganosiloxane polyoxyethyleneoxypropylene glycol copolymer surfactant having a viscosity at 25° C. in the range 500 to 2500 $mm^2/s$.

Example 1

Samples were prepared and tested as referred to above, using as the distillate fuel a commercial vehicle fuel supplied as Gulf diesel and 100 parts of the de-hazing material under test per 1,000,000 parts distillate fuel. The test was carried out at room temperature. The percentage light transmittance was determined after 0, 24, 48 and 96 hours. The results are recited in Table 1. From this Table it can be seen that under the test conditions, the illustrative organosiloxane performed better than the comparative materials over each of the 24, 48 and 96 hour periods.

TABLE 1

| Composition | Percentage Light Transmittance After 0 | 24 | 48 | 96 hours |
|---|---|---|---|---|
| None | 26 | 64 | 74 | 82 |
| Comparative A | 24 | 60 | 71 | 81 |
| Comparative B | 29 | 66 | 74 | 84 |
| Third Illustrative | 26 | 80 | 94 | 96 |

EXAMPLE 2

Samples were prepared and tested as referred to above, using as the distillate fuel a commercial vehicle fuel supplied as Shell diesel and 100 parts of the de-hazing material under test to 1,000,000 parts distillate fuel. The test was carried out at room temperature. The percentage transmittance was determined after 0, 24, 48 and 96 hours. The results are recited in Table 2. From this Table it can be seen that under the test conditions, the illustrative organosiloxane performed better than the comparative materials over each of the 24, 48 and 96 hour periods.

TABLE 2

| Composition | Percentage Light Transmittance After 0 | 24 | 48 | 96 hours |
|---|---|---|---|---|
| None | 20 | 47 | 66 | 84 |
| Comparative A | 27 | 50 | 71 | 75 |
| Comparative B | 32 | 61 | 69 | 83 |
| Third Illustrative | 20 | 71 | 94 | 98 |

EXAMPLE 3

Samples were prepared and tested as referred to above, using as the distillate fuel a commercial vehicle fuel supplied as U.K. diesel and 100 parts of the de-hazing material under test to 1,000,000 parts distillate fuel. The test was carried out at room temperature. The percentage transmittance was determined after 0, 24, 48 and 96 hours. The results are recited in Table 3. From this Table it can be seen that under the test conditions, the illustrative organosiloxane performed better than the comparative materials over each of the 48 and 96 hour periods.

TABLE 3

| Composition | Percentage Light Transmittance After 0 | 24 | 48 | 96 hours |
|---|---|---|---|---|
| None | 29 | 50 | 74 | 93 |
| Comparative A | 30 | 64 | 78 | 90 |
| Comparative B | 33 | 76 | 82 | 93 |
| Third Illustrative | 26 | 71 | 83 | 97 |

EXAMPLE 4

Samples were prepared and tested as referred to above, using as the distillate fuel a commercial vehicle fuel supplied as Esso diesel and 400 parts of the de-hazing material under test to 1,000,000 parts distillate fuel to which was added 0.1% by weight of detergent additive composition including materials effective as detergents, cold flow improvers, viscosity modifiers, or the like and which has the characteristic of stabilising the haze. The test was carried out at room temperature. The percentage light transmittance was determined before addition of the detergent additive and then after the addition after 24, 48 and 96 hours. The results are recited in Table 5. From this Table it can be seen that under the test conditions, the illustrative organosiloxane performed better than the comparative material over each of the 24, 48 and 96 hour periods.

TABLE 4

| Composition | Before Addition | Percentage Light Transmittance After 24 | 48 | 96 | hours |
|---|---|---|---|---|---|
| None | 22 | 20 | 51 | 93 | |
| Comparative B | 22 | 18 | 41 | 85 | |
| Comparative C | 22 | 17 | 39 | 81 | |
| First Illustrative | 22 | 37 | 85 | 99 | |
| Second Illustrative | 22 | 37 | 85 | 99 | |

EXAMPLE 5

Example 4 was repeated using different de-hazer materials. The results are recited in Table 5. From this Table it can be seen that under the test conditions, the illustrative organosiloxanes performed better than the comparative material over each of the 24, 48 and 96 hour periods, the first and fourth illustrative organosiloxanes being the most effective over the 48 hour period.

TABLE 5

| Composition | Before Addition | Percentage Light Transmittance After 24 | 48 | 96 | hours |
|---|---|---|---|---|---|
| None | 29 | 25 | 48 | 94 | |
| Comparative C | 29 | 24 | 47 | 90 | |
| First Illustrative | 29 | 43 | 77 | 99 | |
| Second Illustrative | 29 | 36 | 68 | 99 | |
| Fourth Illustrative | 29 | 42 | 80 | 97 | |
| Fifth Illustrative | 29 | 26 | 52 | 98 | |

EXAMPLE 6

The performances in preventing formation of a haze in Esso Diesel containing 0.1% addition of the detergent additive used in Example 4, of various quaternary ammonium salts of organosiloxanes is compared with the performance of materials previously advocated for use as de-hazers for distillate fuel. The comparisons were made using samples taken from a test batch prepared in a similar manner to those used for Examples 1 to 5 by mixing the materials in a high shear mixer, except that the de-hazer was added to the distillate fuel before measured quantities of water were mixed in. Periodically, sample portions were removed from the test batches, charged into clear glass containers and their light transmittance measured using a WPA C065 colorimeter. The proportion of incident light transmitted through each sample was recorded as a percentage. As the haze cleared the proportion of light transmitted increased. No haze was visible to the naked eye when the light transmittance had increased to about 97%. The results are shown in Table 6. Preparation of the batch and testing of the samples were all undertaken at room temperature, i.e. 22° C.

TABLE 6

| Composition | Water Added (Wt. % of Fuel) | Percentage Light Transmittance After 0 | 48 | 144 | hours |
|---|---|---|---|---|---|
| None | 0.1 | 60 | 83 | | |
| | 0.2 | 13 | 27 | | |
| | 0.4 | 7 | 25 | | |
| | 0.8 | 4 | 36 | | |
| | 1.6 | 2 | 50 | | |
| Comparative C | 0.1 | 100 | 100 | 100 | |
| | 0.2 | 57 | 95 | 92 | |

TABLE 6-continued

| Composition | Water Added (Wt. % of Fuel) | Percentage Light Transmittance After 0 | 48 | 144 | hours |
|---|---|---|---|---|---|
| | 0.4 | 29 | 77 | 81 | |
| | 0.8 | 16 | 69 | 73 | |
| | 1.6 | 19 | 66 | 75 | |
| First Illustrative | 0.1 | 99 | 100 | 100 | |
| | 0.2 | 18 | 69 | 100 | |
| | 0.4 | 7 | 67 | 99 | |
| | 0.8 | 4 | 67 | 98 | |
| | 1.6 | 2 | 25 | 84 | |

These results show that although comparative material C is able to resist formation of a haze in the fuel better than is the first illustrastive material, the first illustrative material was more effective in clearing haze which may occur.

That which is claimed is:

1. A method of de-hazing distillate fuel which comprises adding to the fuel an organosiloxane having at least one quaternary ammonium substituted siloxane unit having the general formula $$R_aZSiO_{(3-a)/2} \quad \text{(i)}$$

in which a has the value 1 or 2, each R is selected from the group consisting of substituted and unsubstituted hydrocarbon groups having up to 10 carbon atoms, provided that one R may be a hydroxyl group when a has the value 2, Z represents a quaternary ammonum group having the formula $$R'N^+(R^2)_3X^- \quad \text{(ii)}$$

linked to the siilcon atom of the siloxane unit, in which R' represents a divalent hydrocarbon group linking the silicon and nitrogen atoms, each $R^2$ represents an alkyl group having up to 20 carbon atoms and $X^-$ represents a halogen ion, said distillate fuel containing up to about 0.1 percent by weight of water dispersed therein.

2. A method according to claim 1 wherein the organosiloxane is composed exclusively of units (i).

3. A method according to claim 1 wherein the organosiloxane is a polydiorganosiloxane composed of siloxane units (i) and siloxane units according to the general formula $$R_bSiO_{(4-b)/2} \quad \text{(iii)}$$

in which each R is a substituted or unsubstituted hydrocarbon group of up to 10 carbon atoms and b has the value 1, 2, or 3.

4. A method according to claim 3 wherein the organosiloxane is a polydiorganosiloxane according to the average general formula $$R_3SiO(R_2SiO)_x(RSiOR'N^+(R^2)_3X^-)_ySiR_3 \quad \text{(iv)}$$

in which x has a value in the range 1 to 150, y has a value in the range 1 to 10 and the ratio of x+y/y lies in the range 2 to 25.

5. A method according to claim 1 wherein not less than 80% of the groups R are methyl.

6. A method according to claim 1 wherein the group R' is an alkylene group according to the formula $-(CH_2)_n-$ where n has a value in the range 2 to 10.

7. A method according to claim 1 wherein two of the groups $R^2$ have 1 to 5 carbon atoms and one of the groups $R^2$ has a chain of 10 to 15 carbon atoms.

8. A method according to claim 1 wherein the halogen ion $X^-$ is an iodide or chloride ion.

9. A distillate fuel when treated by a method according to claim 1.

10. A distillate fuel according to claim 9 wherein the distillate fuel is a diesel fuel.

11. A mixture consisting essentially of:

(I) a distillate fuel;

(II) up to about 0.1 percent by weight of water based on the weight of said distillate fuel; and (III) a de-hazing amount of an organosiloxane having at least one quaternary ammonium substituted siloxane unit having the general formula $$R_aZSiO_{(3-a)/2} \quad \text{(i)}$$

in which a has the value 1 or 2, each R is selected from the group consisting of substituted and unsubstituted hydrcarbon groups having up to 10 carbon atoms, provided that one R may be a hydroxyl group when a has the value 2, Z represents ammonium group having the formula $$R'N^+(R^2)_3X^- \quad \text{(ii)}$$

linked to the silicon atom of the siloxane unit, in which R' represents a divalent hydrocarbon group linking the silicon and nitrogen atoms, each $R^2$ represents an alkyl group having up to 20 carbon atoms and $X^-$ represents a halogen ion.

12. A fuel according to claim 11 wherein the organosiloxane is composed exclusively of units (i).

13. A fuel according to claim 11 wherein the organosiloxane is a polydiorganosiloxane composed of siloxane units (i) and siloxane units according to the general formula $$R_bSiO_{(4-b)/2} \quad \text{(iii)}$$

in which each R is a substituted or unsubstituted hydrocarbon group of up to 10 carbon atoms and b has the value 1, 2, or 3.

14. A fuel according to claim 11 wherein the organosiloxane is a polydiorganosiloxane according to the average general formula $$R_3SiO(R_2SiO)_x(RSiOR'N^+(R^2)_3X^-)_ySiR_3 \quad \text{(iv)}$$

in which x has a value in the range 1 to 150, y has a value in the range 1 to 10 and the ratio of x+y/y lies in the range 2 to 25.

15. A fuel according to claim 14 wherein not less than 80% of the groups R are methyl.

16. A fuel according to claim 11 wherein the group R' is an alkylene group according to the formula $—(CH_2)_n—$ where n has a value in the range 2 to 10.

17. A fuel according to claim 11 wherein two of the groups $R^2$ have 1 to 5 carbon atoms and one of the groups $R^2$ has a chain of 10 to 15 carbon atoms.

18. A fuel according to claim 11 wherein the halogen ion $X^-$ is an iodide or chloride ion.

19. A fuel according to claim 11 wherein the fuel is a diesel fuel.

* * * * *